US010239059B2

(12) United States Patent
Toh et al.

(10) Patent No.: US 10,239,059 B2
(45) Date of Patent: Mar. 26, 2019

(54) THERMAL CYCLER COVER

(71) Applicant: LIFE TECHNOLOGIES CORPORATION, Carlsbad, CA (US)

(72) Inventors: Tiong Han Toh, Singapore (SG); Wuh Ken Loh, Singapore (SG); Kuan Moon Boo, Singapore (SG); Sandro Klein, Irvine, CA (US); Daniel Welsh, Encinitas, CA (US)

(73) Assignee: LIFE TECHNOLOGIES CORPORATION, Carlsbad, CA (US)

( * ) Notice: Subject to any disclaimer, the term of this patent is extended or adjusted under 35 U.S.C. 154(b) by 0 days.

(21) Appl. No.: 14/778,106

(22) PCT Filed: Feb. 14, 2014

(86) PCT No.: PCT/US2014/016397

§ 371 (c)(1),
(2) Date: Sep. 18, 2015

(87) PCT Pub. No.: WO2014/149268

PCT Pub. Date: Sep. 25, 2014

(65) Prior Publication Data

US 2016/0228875 A1 Aug. 11, 2016

Related U.S. Application Data

(60) Provisional application No. 61/803,390, filed on Mar. 19, 2013.

(51) Int. Cl.
*B01L 7/00* (2006.01)

(52) U.S. Cl.
CPC ..... *B01L 7/52* (2013.01); *B01L 2300/043* (2013.01); *B01L 2300/1822* (2013.01)

(58) Field of Classification Search
CPC ..... B01L 7/52; B01L 2300/1822; B01L 2300/043
See application file for complete search history.

(56) References Cited

U.S. PATENT DOCUMENTS 5,346,672 A 9/1994 Stapleton et al.
5,508,197 A 4/1996 Hansen et al.
(Continued)

FOREIGN PATENT DOCUMENTS

CN 1506452 A 6/2004
DE 202008009556 1/2010
(Continued)

OTHER PUBLICATIONS

PCT/US2014/016397, International Preliminary Report on Patentability dated Oct. 1, 2015, 9 Pages.
(Continued)

*Primary Examiner* — Guatam Prakash

(57) ABSTRACT

In one aspect, a thermal cycler system is disclosed. The thermal cycler can be comprised of a device housing and a cover that is operably connected to the device housing. The cover can include a handle portion, a device lid portion, a sample block platen, and a link bar. The device lid portion is attached to the proximal side of the handle portion with a first pin. The sample block platen is operably connected to the handle portion such that the sample block platen is positioned against the sample block when the handle portion is flush with the device lid portion and the cover is in a closed position. The link bar is pivotably connected to the device housing at a first terminal end portion and a second pin at an opposite second terminal end portion, wherein the handle portion is elevated away from the device lid portion before the cover is moved to an open position.

18 Claims, 4 Drawing Sheets

(56) References Cited

U.S. PATENT DOCUMENTS

| | | | |
|---|---|---|---|
| 5,535,637 | A | 7/1996 | Baker et al. |
| 5,602,756 | A | 2/1997 | Atwood |
| 5,604,130 | A | 2/1997 | Warner et al. |
| 5,616,301 | A | 4/1997 | Moser et al. |
| 5,681,741 | A | 10/1997 | Atwood et al. |
| 5,710,381 | A | 1/1998 | Atwood et al. |
| 5,851,492 | A | 12/1998 | Blattner |
| 5,928,907 | A | 7/1999 | Woudenberg et al. |
| 6,015,674 | A | 1/2000 | Woudenberg et al. |
| 6,133,045 | A | 10/2000 | Johnson et al. |
| 6,153,426 | A | 11/2000 | Heimberg |
| 6,159,368 | A | 12/2000 | Moring et al. |
| 6,197,572 | B1 | 3/2001 | Schneebeli |
| 6,423,536 | B1 | 7/2002 | Jovanovich et al. |
| 6,555,792 | B1 | 4/2003 | Elsener et al. |
| 6,556,940 | B1 | 4/2003 | Tretiakov et al. |
| 6,638,761 | B2 | 10/2003 | Shin et al. |
| 8,198,051 | B2 | 6/2012 | Schicke et al. |
| 2001/0046688 | A1 | 6/2001 | Shin |
| 2002/0028507 | A1 | 3/2002 | Heimberg et al. |
| 2002/0110900 | A1 | 8/2002 | Jovanovich et al. |
| 2002/0172629 | A1 | 11/2002 | Jahn et al. |
| 2003/0044969 | A1 | 3/2003 | Shin et al. |
| 2003/0066667 | A1 | 8/2003 | Jovanovich et al. |
| 2003/0215357 | A1 | 11/2003 | Malterer et al. |
| 2003/0224395 | A1 | 12/2003 | Jovanovich et al. |
| 2004/0018610 | A1 | 1/2004 | Sandell |
| 2004/0033592 | A1 | 2/2004 | Shin et al. |
| 2004/0112969 | A1 | 6/2004 | Saga et al. |
| 2005/0282270 | A1 | 12/2005 | Shin et al. |
| 2006/0141612 | A1 | 6/2006 | Yamamoto et al. |
| 2007/0077657 | A1 | 4/2007 | Carlson et al. |
| 2007/0184548 | A1 | 8/2007 | Tan et al. |
| 2007/0269347 | A1 | 11/2007 | Stanchfield et al. |
| 2008/0274511 | A1 | 11/2008 | Tan et al. |
| 2010/0124766 | A1* | 5/2010 | Ng et al. ..... B01L 7/52 435/91.2 |
| 2015/0217292 | A1 | 8/2015 | Ng et al. |

FOREIGN PATENT DOCUMENTS

| | | |
|---|---|---|
| EP | 0955097 | 11/1999 |
| EP | 1088950 | 4/2001 |
| JP | H07-231798 | 9/1995 |
| JP | 2004187521 | 7/2004 |
| WO | WO-98/43740 | 10/1998 |
| WO | WO-01/56697 | 8/2001 |
| WO | WO-2006/002226 | 1/2006 |
| WO | WO-2008/030914 | 3/2008 |

OTHER PUBLICATIONS

PCT/US2014/016397, International Search Report and Written Opinion dated Jun. 10, 2014, 11 pp.

SG11201507799P Written Opinion dated Nov. 9, 2016, 7 pgs.

* cited by examiner

THERMAL CYCLER COVER

CROSS-REFERENCE TO RELATED APPLICATIONS

This application is a U.S. 371 national phase of International application no. PCT/US2014/016397 filed Feb. 14, 2014, which claims priority to U.S. application No. 61/803,390 filed Mar. 19, 2013, which disclosures are herein incorporated by reference in their entirety.

FIELD

Provided herein are systems and apparatuses for providing a heated cover on a thermal cycler, and limiting access to the heated platen.

BACKGROUND

A thermal cycler's well tray area requires a cover with a good seal, and a tight fit with even pressure across the top of the well tray. This eliminates any condensation build-up, and ensures the tray is securely pressed into the thermal block for both even and accurate thermal transfer during cycles. With many instruments, including the APPLIED BIOSYSTEMS' models VERITI™, 2720 and PROFLEX™, when the heated cover is open, the handle is further behind. So, when closing, the user may inadvertently grab the heated cover instead, and possibly burning themselves, or pinching their fingers when swinging the handle over when locking down. Moreover, the user can sometimes mistakenly think that the tray clamp is in place, even when its not, when the cover is in a closed position.

Previous designs have sought to solve this problem by incorporating a heated cover with a locking handle or latch to ensure the cover is securely closed, and a combination of a crank, spin wheel or knob, to put even pressure over the well tray without damaging it. These previous designs, however, have not provided mechanisms or features to allow the safe handling of the heated cover and ensure that the tray clamp is fully engaged when the cover is closed. The present teachings address the deficiencies of the previous designs.

DRAWINGS

For a more complete understanding of the principles disclosed herein, and the advantages thereof, reference is now made to the following descriptions taken in conjunction with the accompanying drawings, in which.

Figure 1:
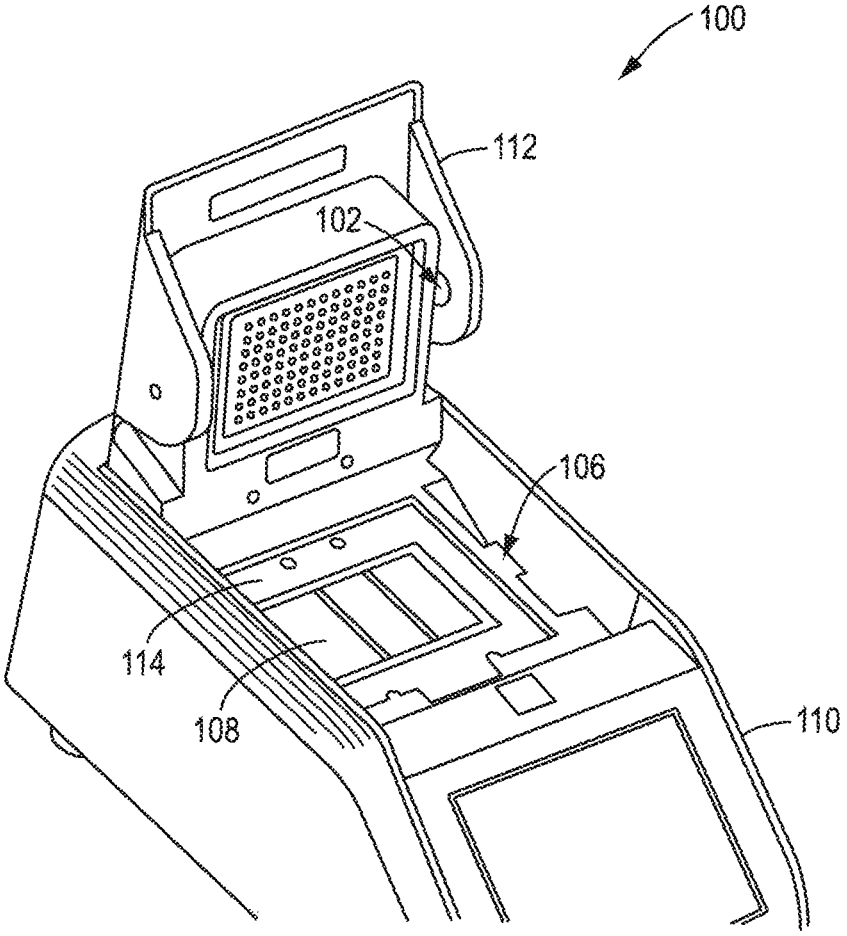
FIG. 1 is an illustration of a thermal cycler system with an improved cover, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

SUMMARY

Systems and apparatuses for providing a heated cover on a thermal cycler are described herein.

In one aspect, a thermal cycler system is disclosed. The thermal cycler can be comprised of a device housing and a cover that is operably connected to the device housing. The device housing can include a sample block with a top and a bottom surface and a thermal electric device in thermal communication with the bottom surface.

The cover can include a handle portion, a device lid portion, a sample block platen and a link bar. The device lid portion is attached to the proximal side of the handle portion with a pin. The sample block platen is operably connected to the handle portion such that the sample block platen is positioned against the sample block when the handle portion is flush with the device lid portion and the cover is in a closed position. The link bar is operably connected to the device housing and the pin such that a distal side of the handle portion is elevated away from the device lid portion when the cover is moved to an open position.

In another aspect, a device cover is disclosed. The device cover can be comprised of a handle portion, a device lid portion and a link bar. The device lid portion can be attached to a proximal side of the handle portion with a pin. The link bar can be operably connected to the device housing and the proximal side of the handle portion such that a distal side of the handle portion is elevated away from the device lid portion when the cover is moved to an open position.

These and other features, aspects, and embodiments of the invention are described below in the section entitled "Description of Various Embodiments."

DESCRIPTION OF VARIOUS EMBODIMENTS

Embodiments of systems and apparatuses for providing a heated cover on a thermal cycler are described herein. Details of the various embodiments of these systems and apparatuses are illustrated with reference to the exemplary and non-limiting drawings included with this specification.

It will be appreciated that there is an implied "about" prior to the temperatures, concentrations, times, number of bases, coverage, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

FIG. 1 is an illustration of a thermal cycler system with an improved cover, in accordance with various embodiments. As depicted herein, the thermal cycler system 100 can include a device housing 110 and a cover 112.

In various embodiments, the device housing 110 can include a sample block 108 having a top and a bottom surface. The cover 112 can be operably connected to the device housing 110 by way of a hinge, a pin or other equivalent attachment mechanism that can pivot the cover 112 from an open position to a close position and vice versa. The cover 112 can include a latch 102 that is configured to latch onto a latch block 106 on the device housing when the cover 112 is in a closed position. In various embodiments, the latch block 106 extends from a drip pan 114 that houses the sample block 108. In various embodiments, the latch block 106 is attached to the drip pan 114 housing the sample block 108.

Figure 2A:
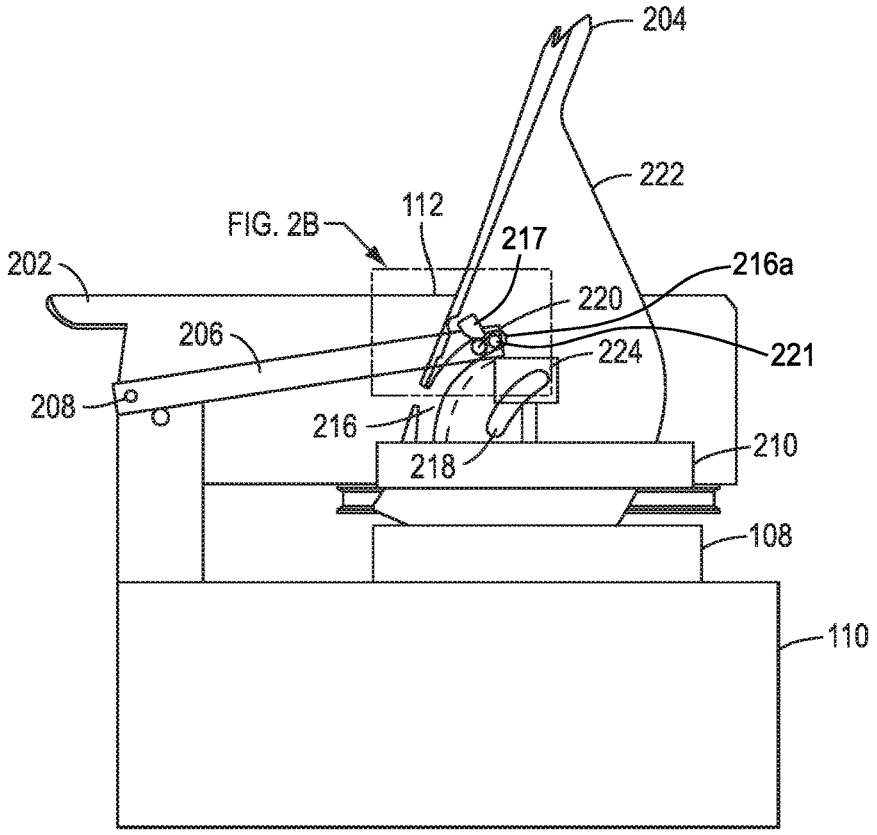
FIG. 2A is an illustration of a cover with a handle portion that is in an elevated position relative to a device lid portion, in accordance with various embodiments.

FIG. 2A is an illustration of a cover with a handle portion that is in an elevated position relative to a device lid portion, in accordance with various embodiments.

As depicted herein, a thermal cycler system can include a device housing 110 and a cover 112. The device housing can include a sample block 108 with a top surface and a bottom surface. In various embodiments, the top surface of the sample block 108 can include one or more openings or wells to receive sample vials or well array plates containing a nucleic acid sample and reagents for amplifying the nucleic acid sample using a polymerase chain reaction (PCR) process. In various embodiments, the bottom surface of the sample block 108 is in thermal communication with a thermal electric device.

In various embodiments, the thermal electric device can be a Peltier thermoelectric device that can be constructed of pellets of a n-type and p-type semiconductor material that are alternately placed in parallel to each other and are connected in series. Examples of semiconductor materials that can be utilized to form the pellets in a Peltier device include, but are not limited to, bismuth telluride, lead telluride, bismuth selenium and silicon germanium. However, it should be appreciated that the pellets can be formed from any semiconductor material as long as the resulting Peltier device exhibits thermoelectric heating and cooling properties when a current is run through the Peltier device. In various embodiments, the interconnections between the pellets can be made with copper which can be bonded to a substrate, usually a ceramic (typically alumina).

In various embodiments, the cover 112 can be comprised of a handle portion 222, a device lid portion 202, a sample block platen 210, and a link bar 206. The device lid portion 202 can be attached to a proximal side of the handle portion 222 with a first pin 220. As used herein, the proximal side of the handle portion 222 denotes the side nearest the attachment point between the handle portion 222 and the device lid portion 202.

Figure 2B:
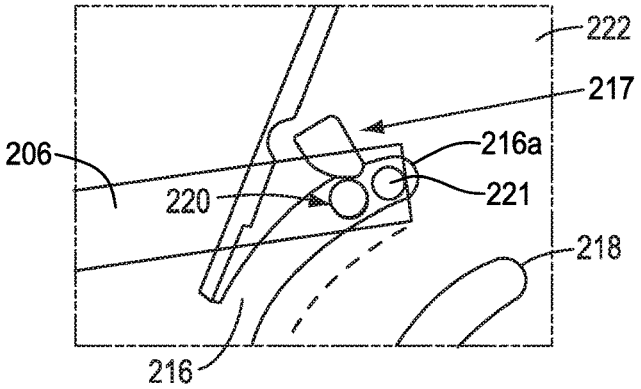
FIG. 2B is an illustration showing an expanded view of how a pin latches onto the elliptical slot opening of the handle portion, in accordance with various embodiments.
Figure 3A:
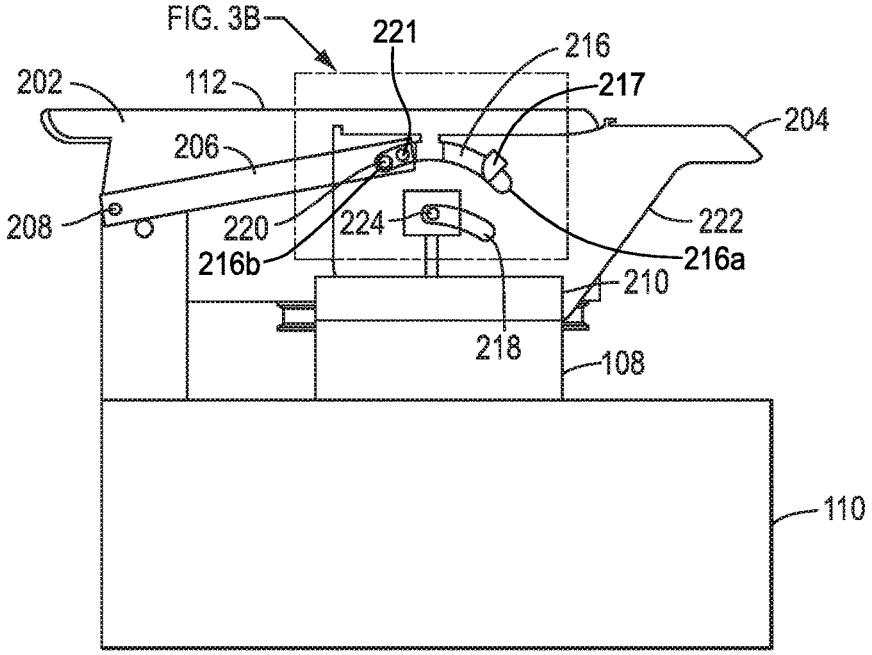
FIG. 3A is an illustration of a cover with a handle portion flush with a lid portion, in accordance with various embodiments.
Figure 3B:
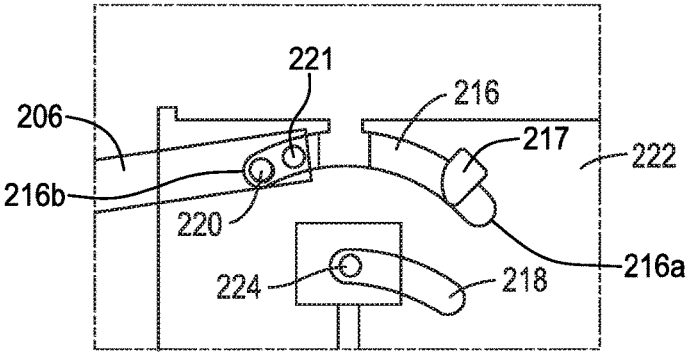
FIG. 3B is an illustration showing an expanded view of how a platen pin latches onto the platen slot opening of the handle portion, in accordance with various embodiments.

FIG. 2B is an illustration showing an expanded view of how the first pin 220 latches onto the elliptical slot opening 216 of the handle portion 222. As shown, the first pin 220 protrudes from the device lid portion 202 and latches onto an elliptical slot opening 216, comprising a first terminal end 216*a* and a second terminal end 216*b* (the latter of which is shown in FIGS. 3A and 3B), on the proximal side of the handle portion 222. In various embodiments, the first pin 220 is an unbroken part of the device lid portion 202. In various embodiments, the first pin 220 is a separate part that is secured and/or attached to the device lid portion 202. A link bar 206 is operably connected to the device housing 110 (via a pin 208 as further described below) and a second pin 221 such that a distal side 204 of the handle portion 222 is first elevated away from the device lid portion 202 before the cover 112 (i.e., both the device lid portion 202 and the handle portion 222) can be moved to an open position (as shown in FIG. 1). This sequence occurs because the distal side 204 of the handle portion 222 must be elevated to an angle of between about 30 degrees to about 70 degrees relative to the device lid portion 202 before the link bar 206 (which is attached to the device housing 110 through a lid pin 208) pushes the second pin 221 to engage the first terminal end 216*a* of the elliptical slot opening 216, at which point continued upward (elevating) movement of the handle portion 222 causes the cover 112 (i.e., handle portion 222 together with lid portion 202) and link bar 206 to begin pivoting about pin 208 to the open position shown in FIG. 1 (link bar 206 being hidden in the prespective view shown). As shown in FIGS. 2A and 2B, elevation of the handle portion 222 relative to the device lid portion 202 results in relative movement of the pin 220, attached to the device lid portion, in elliptical slot opening 216 (i.e., movement from the second terminal end 216*b* in the lowered position of the handle portion shown in FIGS. 3A, 3B, and 4B to proximate the pin 221 at the first terminal end 216*a* in the elevated position of the handle portion 222).

Figure 4A:
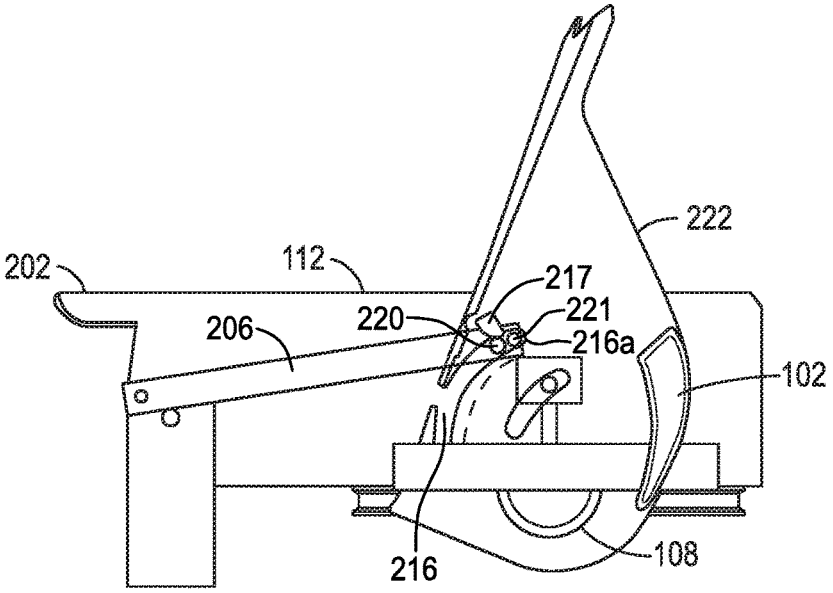
FIG. 4A is an illustration of an unlatched cover, in accordance with various embodiments.
Figure 4B:
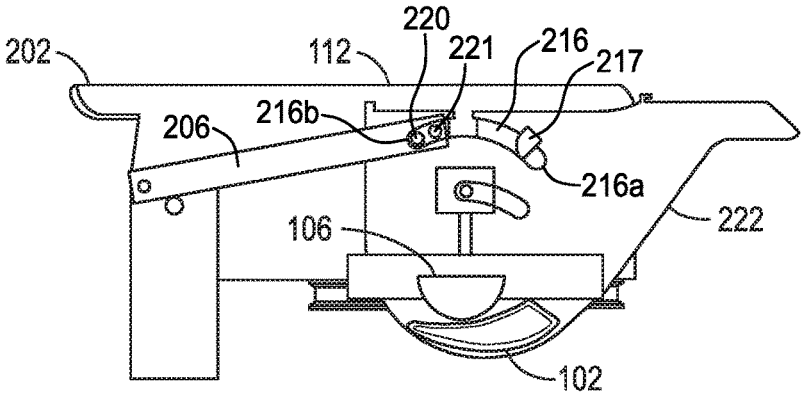
FIG. 4B is an illustration of a latched cover, in accordance with various embodiments.

Given that the first pin 220 is attached to the device lid portion 202, the first pin 220 can continue to move relative to the handle portion 222 along the elliptical slot opening 216 as the device lid portion 202 is raised. With the cover 112 in the open position, one of ordinary skill in the art understands that the first pin 220 reaches the second terminal end 216*b* of elliptical slot opening 216, while second pin 221 remains at the first terminal end 216*a*, by virtue of the handle portion 222 and device lid portion 202 being freely pivotable relative to each other about the first pin 220, and the handle portion 222 and the link bar 206 moving together about the pin 208. Closing the cover 112 involves a reversal of the movements described with respect to opening the cover 112, such that the device lid portion 202 and the handle portion 222 move to the positions depicted in FIGS. 2A, 2B, and 4A, resulting in the first and second pins 220, 221 reversing direction of movement from that described in the opening sequence. Ultimately, both the first and second pins 220, 221 are positioned toward the second terminal end 216*b* second end 216*b* with the cover 112 in a closed position and the handle portion 222 is in a flush position with the device lid portion 202. This state is shown in FIGS. 3A, 3B, and 4B, in which both the device lid portion 202 and the handle portion 222 are fully lowered.

With reference again to FIGS. 2-4, the handle portion 222 can also include a pin catch 217 that extends into the elliptical slot opening 216. FIGS. 2A, 2B, and 4A show the pin catch 217 in the elevated position of the handle portion 222 relative to lid portion 202. FIGS. 3A, 3B, and 4B show the pin catch 217 in the closed position of the cover 112 and flush position of the distal side 204 of the handle portion 222 relative to the lid portion 202. In FIGS. 2A, 2B, and 4A, the pin catch 217 is shown positioned between the first pin 220 and second pin 221 to catch second pin 221 when the handle portion 222 is elevated to the position to allow the cover 112 (i.e., handle portion and lid portion) to begin pivoting to the open position. With the pin catch 217 having caught the second pin 221, the handle portion 222 and the link bar 206 can have a more secure connection and continued motion of the handle portion 222, and thus cover 112, to the open position. When the cover 112 is closing, movement of the first pin 220 back to the first terminal end 216*b* of the elliptical slot 216 engages the pin catch 217 to move the pin catch and release the second pin 221 from the pin catch 217, allowing both pins 220, 221 to reverse the direction of movement from the opening sequence. In other words, the pins 220, 221 move from the first terminal end 216a to the second terminal end 216b of the elliptical slot opening 216 as the device lid portion 202 is lowered and the handle portion 222 is lowered relative to the device lid portion 202 to place the cover 112 back in the fully closed position. As shown in the figures, this release can be aided by providing the pin catch 217 with a chamfered (beveled or curved) edge.

The sample block platen 210 is operably connected to the handle portion 222 such that the sample block platen 210 is positioned against the sample block 108 when the handle portion 222 is flush with the device lid portion 202. FIG. 2A depicts the distal side 204 of the handle portion 222 in an elevated position, and FIG. 3A shows the distal side 204 of the handle portion 222 in the flush position relative to the device lid portion 202. As shown therein, when the handle portion 222 is moved by a user to the flush position relative to the device lid 202 portion, pressure is applied at the same time to the sample block platen 210 such that it is pressed against the sample block 108 with sufficient force to create a thermal seal between the sample block platen 210 and the sample block 108. The mechanism by which this occurs is clearly shown in FIG. 3B which provides an expanded view of how the platen pin 224 latches onto the platen slot opening 218 of the handle portion 222. When a user applies force to push the distal side 204 of the handle portion 222 so that it is flush with the device lid portion 202, the platen pin 224 engages a terminal end of the platen slot opening 218 to cause the sample block platen 210 to be pushed down with a similar amount of force as the user applies to the handle portion 222.

The sample block platen 210 is operably connected to the handle portion 222 such that the sample block platen 210 is positioned against the sample block 108 when the handle portion 222 is flush with the device lid portion 202. FIG. 2A depicts the distal side of the handle portion 204 in an elevated position and FIG. 3A shows the distal side of the handle portion 204 in a flushed position relative to the device lid portion 202. As shown therein, when the handle portion 222 is moved by a user to a flushed position relative to the device lid 202 portion, pressure is applied at the same time to the sample block platen 210 such that it is pressed against the sample block 108 with sufficient force to create a thermal seal between the sample block platen 210 and the sample block 108. The mechanism by which this occurs is clearly shown in FIG. 3B which provides an expanded view of how the platen pin 224 latches onto the platen slot opening 218 of the handle portion 222. When a user applies force to push the distal side of the handle portion 204 so that it is flush with the device lid portion 202, the platen pin 224 engages a terminal end of the platen slot opening 218 to cause the sample block platen 210 to be pushed down with a similar amount of force as the user applies to the handle portion 222.

FIG. 4A is an illustration of an unlatched cover 112 and FIG. 4B is an illustration of a latched cover 112, in accordance with various embodiments. As shown herein, the cover 112 includes a handle portion 222 that has a latch 102 that is configured to latch onto a latch block 106 that is attached to the drip pan housing the sample block when the handle portion 222 is flush with the device lid portion 202. In various embodiments, the latch block 106 extends from a drip pan 114 that houses the sample block 108. In various embodiments, the latch block 106 is attached to the drip pan 114 housing the sample block 108.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

What is claimed is:

1. A thermal cycler system, comprising:

a device housing including:

a sample block with a top and a bottom surface;

a thermal electric device in thermal communication with the bottom surface; and a cover operably connected to the device housing, the cover being moveable between an open position to provide access to the sample block and a closed position to cover the sample block, the cover comprising:

a handle portion having a distal side and a proximal side, the handle portion comprising an elliptical slot opening disposed at a proximal side of the handle portion and extending in a distal-to-proximal direction from a first terminal end to a second terminal end of the elliptical slot opening, the distal side of the handle portion being positioned to be grasped by a user to elevate the handle portion relative and to lower the handle portion;

a device lid portion coupled to the proximal side of the handle portion via a first pin received and moveable in the elliptical slot opening;

a sample block platen operably connected to the handle portion such that the sample block platen is positioned against the sample block when the handle portion is in a flush position with the device lid portion and the cover is in the closed position; and a link bar pivotably connected to the device housing at a first end portion of the link bar, the link bar having a second end portion, opposite the first end portion, connected to a second pin extending into and moveable along the elliptical slot opening of the handle portion, wherein:

the handle portion is configured to be elevated away from and relative to the device lid portion before the cover is moveable to the open position, the second pin is configured to move along the elliptical slot opening in a direction toward the first terminal end of the elliptical slot opening as the handle portion is elevated relative to the device lid portion, and in the position of the second pin at the first terminal end of the elliptical slot opening and in response to continued elevation movement of the handle portion, the handle portion and the device lid portion are moveable together to move the cover to the open position.

2. The thermal cycler system, as recited in claim 1, the first pin is configured to move along the elliptical slot opening in a direction toward the first terminal end of the elliptical slot opening as the handle portion moves to an elevated position relative to the device lid portion and the cover is in the closed position.

3. The thermal cycler system, as recited in claim 1, wherein the first and second pin are located toward the second terminal end of the elliptical slot opening when the cover is in the closed position.

4. The thermal cycler system, as recited in claim 1, wherein, in the open position and in the closed position of the cover, the handle portion is flush with the device lid portion.

5. The thermal cycler system, as recited in claim 4, wherein, the first pin is located at the second terminal end of the elliptical slot opening when the handle portion is flush with the device lid portion.

6. The device cover, as recited in claim 1, wherein the first pin is an unbroken part of the device lid portion.

7. The device cover, as recited in claim 1, wherein the first pin is a separate part that is attached to the device lid portion.

8. The thermal cycler system, as recited in claim 1, wherein the elliptical slot opening is configured to allow the distal side of the handle portion to elevate between an angle of about 30 degrees to about 70 degrees relative to the device lid portion before the cover is moveable to the open position.

9. The thermal cycler system, as recited in claim 1, wherein the sample block platen thermally seals the sample block when the handle portion is flush with the device lid portion and when the cover is in the closed position.

10. The thermal cycler system, as recited in claim 1, wherein the sample block platen is connected to handle portion with a platen pin that latches onto a platen slot opening on the proximal side of the handle portion.

11. The thermal cycler system, as recited in claim 1, wherein the handle portion further includes a grip configured to provide a gripping surface to allow a user to hold the handle portion.

12. The thermal cycler system, as recited in claim 1, wherein the sample block platen latches onto a platen slot opening on the proximal side of the handle portion.

13. The thermal cycler system, as recited in claim 12, wherein the platen slot opening is configured to retract the sample block platen towards the cover when the distal side of the handle portion is elevated.

14. The thermal cycler system, as recited in claim 13, wherein the platen slot opening is configured to extend the sample block platen away from the cover when the cover is in an open position.

15. The thermal cycler system, as recited in claim 1, further comprising a pin catch configured to catch the second pin at the first end of the elliptical slot opening.

16. The thermal cycler system, as recited in claim 1, further including a drip pan that houses the sample block.

17. The thermal cycler system, as recited in claim 16, wherein the drip pan further includes a latch block.

18. The thermal cycler system, as recited in claim 17, further including a latch that protrudes from the distal side of the handle portion, wherein the latch is configured to latch onto the latch block when the handle portion is flush with the device lid portion and the cover is in the closed position.

* * * * *